United States Patent [19]

Wolpert et al.

[11] 4,357,931

[45] Nov. 9, 1982

[54] FLAMELESS HEAT SOURCE

[76] Inventors: Kenneth R. Wolpert, 337 Poplar; George H. Wolpert, Jr., 1044 Park Ave., both of Columbia, Pa. 17512

[21] Appl. No.: 186,342

[22] Filed: Sep. 11, 1980

[51] Int. Cl.[3] ..... F24C 9/00; F22B 3/06; F24D 3/00

[52] U.S. Cl. ..... 126/247; 122/26; 237/12; 237/8 A

[58] Field of Search ..... 126/247; 122/26; 165/86, 89; 237/12.1, 2 A, 12, 8 R, 8 A; 416/4

[56] References Cited

U.S. PATENT DOCUMENTS

| | | | |
|---|---|---|---|
| 2,683,448 | 7/1954 | Smith | 126/247 |
| 3,273,631 | 9/1966 | Neuman . | |
| 3,333,771 | 8/1967 | Graham . | |
| 3,720,372 | 3/1973 | Jacobs | 122/26 X |
| 3,820,718 | 6/1974 | Ammon | 239/135 |
| 4,004,553 | 1/1977 | Stenstrom | 122/26 |
| 4,033,081 | 7/1977 | Perkins, Jr. | 126/247 X |
| 4,143,639 | 3/1979 | Frenette | 126/247 |
| 4,256,085 | 3/1981 | Line | 126/247 |

*Primary Examiner*—Samuel Scott
*Assistant Examiner*—Randall L. Green
*Attorney, Agent, or Firm*—Sixbey, Friedman & Leedom

[57] ABSTRACT

The present invention comprises a heat source wherein a vaned rotor (2) is rotatably supported within a cavity (18) formed in a casing (16). Inlet (42) and outlet (54) ports in the casing (16) respectively conduct heat transfer fluid to and from the cavity (18). Heat is generated by blocking the inlet (42) and outlet (54) ports while rotating the vaned rotor (2) to impart mechanical energy of motion to heat transfer fluid contained within the cavity (18). Frictional forces subsequently developed between layers of rotating fluid particles serve to convert essentially all of the mechanical energy of motion of the fluid particles into heat. After the heat transfer fluid reaches a predetermined temperature, the rotation of the vaned rotor (2) is stopped and the inlet (42) and outlet (54) ports are unblocked, thereby enabling the conduction of hot heat transfer fluid to a remote heat transfer surface (116). An electrical control circuit (C) governs the sequencing of the heat generating and transfer cycles.

15 Claims, 6 Drawing Figures

FLAMELESS HEAT SOURCE

DESCRIPTION

1. Technical Field

This invention relates to the field of heating devices and more specifically to the provision of an apparatus capable of efficiently generating usable heat without resort to combustion processes.

2. Background Art

The construction and operation of devices designed to convert the mechanical energy of motion into heat suitable for raising the temperature of a heat transfer fluid have heretofore been disclosed, as evidenced by U.S. Pat. No. 3,273,631, issued to Neuman on Sept. 20, 1966; U.S. Pat. No. 3,333,771, issued to Graham on Aug. 1, 1967; U.S. Pat. No. 3,820,718, issued to Ammon on June 28, 1974; and U.S. Pat. No. 4,004,553, issued to Stenstrom on Jan. 25, 1977. The aforementioned Graham patent is representative of such disclosures. Recognizing the advantages of flameless heat sources and in particular the safety features inherently associated with kinetic as opposed to combustion heating of fluids, Graham proposes an arrangement for an energy conversion means wherein a heat transfer fluid or heating liquid is drawn through a rotor chamber and heated to a desired level by the rotational motion of a rotor mounted in the chamber. While accomplishing the goal of providing a heating unit which generates combustionless heat, Graham nevertheless fails to realize the full heating potential of his rotor structure. This failure is due primarily to the fact that the heating liquid in Graham is continuously circulated through the rotor chamber in accordance with accepted principles of pump operation. As a net result, only a portion of the mechanical energy imparted to the heating liquid by the rotating rotor is connected to thermal energy. The remaining portion of the imparted mechanical energy is diverted to create a discharge pressure at the head end or outlet of the rotor chamber. Thus, with respect to the heat generating process itself, Graham exhibits marked inefficiencies.

Additional limitations inherent in the operation of pump-type fluid heaters render such devices even less attractive for everyday heating applications. As the aforementioned Ammon patent makes clear, the mechanical motion converted to heat by conventional pump-type fluid heaters is in the form of centrifugal motion which is imparted to the fluid particles by the rotating rotor vanes. The particles subsequently collide with the surface of the rotor chamber to convert the energy of linear mechanical motion into heat. At high rotor speeds, the constant collision of fluid particles with the rotor chamber surface tends to induce cavitation, thereby leading to increased wear on the fluid heater components and concommitant maintenance and replacement costs. The action of the fluid particles also tends to pit and corrode the rotor chamber surface, causing further acceleration of wear.

Some of the disadvantages which characterize pump-type fluid heaters may be overcome by employing the friction generated between moving layers of fluid in lieu of the centrifugal motion of fluid particles to convert the energy of motion into heat. U.S. Pat. No. 4,143,639, for example, issued to Frenette on Mar. 13, 1979, discloses a space heater wherein inner and outer drums are concentrically mounted to form a sealed, fluid-tight annular chamber between the exterior surface of the inner drum and the interior surface of the outer drum. A liquid lubricant captive in the annular chamber is heated via friction in response to relative rotation between the drums. In the absence of a need to maintain any pump-like discharge pressure, Frenette manages to make most of the mechanical energy of motion imparted by his rotating drums available for conversion into heat. Moreover, the frictional forces acting on the lubricant between the rotating drums are not the sort of forces which induce cavitation. In spite of avoiding some of the difficulties encountered by prior art pump-type fluid heaters, however, Frenette is unable to fully utilize the heat absorbed by his lubricant once the temperature thereof has been raised. The heated lubricant is simply retained inside the annular chamber and a heat transfer relationship between the lubricant and the exterior surface of the outer drum is responsible for conducting heat to air circulating through the space heater. Such a heat transfer relationship is unfortunately rather inefficient, inasmuch as the exterior of the outer drum presents a less than ideal heat transfer surface to the circulating air. Thus, a significant portion of the heat generated by Frenette is unproductively dissipated within the structure of the outer drum, and additional heat is lost as a result of heat transfer to the enclosed volume in the interior of the inner drum and to the supporting framework and floor upon which the space heater is mounted. Accordingly, Frenette fails to truly meet the need for a practical, safe and flameless heat source capable of both generating and transferring heat in an efficient manner with a minimum of wear on the heat source components.

DISCLOSURE OF THE INVENTION

It is therefore a primary object of the present invention to provide a flameless heat source for generating heat in an efficient and utilitarian manner.

It is another object of the present invention to provide a flameless heat source wherein the mechanical energy of motion is imparted to a heat transfer fluid contained within the heat source such that the mechanical energy of motion is converted into heat.

It is still another object of the present invention to provide a flameless heat source wherein essentially all of the mechanical energy of motion imparted to a heat transfer fluid contained within the heat source is made available for conversion into heat.

It is an additional object of the present invention to provide a flameless heat source which generates heat by imparting the mechanical energy of motion to a heat transfer fluid in a manner such that wear on the heat source components is minimized.

It is a further object of the present invention to provide a flameless heat source wherein a heat transfer fluid, the temperature of which has been increased by converting the mechanical energy of motion of the fluid into heat, is subsequently conducted to an efficient heat transfer surface for the purpose of transferring heat from the fluid to air circulated over the surface. These and other objects of the present invention are achieved by a heat source which employs a vaned rotor rotatably supported within a cavity formed in the heat source casing. Inlet and outlet ports in the casing respectively conduct heat transfer fluid to and from the cavity. During the heat generating cycle, the inlet and outlet ports are blocked and the vaned rotor of the heat source is rotated to impart the mechanical energy of motion to the heat transfer fluid contained within the cavity. Frictional forces thereafter developed between layers of rotating fluid particles serve to convert the mechanical energy of motion of the fluid particles into heat. Return and supply reservoirs respectively mounted over the inlet and outlet ports accomodate any expansion occuring in the heat transfer fluid as a result of heat absorption. The blockage of fluid flow through the cavity removes the need for maintaining a discharge pressure at the outlet port, and consequently essentially all of the mechanical energy of motion imparted to the heat transfer fluid particles is made available for conversion into heat. After an interval of time during which the temperature of the heat transfer fluid rises to a predetermined level, the rotation of the vaned rotor is stopped and the blockage of fluid flow through the heat source cavity is removed to enable the conduction of the hot heat transfer fluid to a remote heat transfer surface. Air is warmed by passing in heat transfer relationship with the heat transfer surface, and the air thus warmed may be used for heating or other purposes. An electrical control system governs the sequence of the heat generating and transfer processes and insures that the temperature of the heat transfer fluid is maintained at an acceptable level by reinitiating the heat generating cycle whenever the temperature of the heat transfer fluid falls below a predetermined level.

BRIEF DESCRIPTION OF THE DRAWINGS

The objects, advantages and benefits of the present invention will become more apparent from the following Brief Description of the Drawings, in which.

BEST MODE FOR CARRYING OUT THE INVENTION

Figure 1:
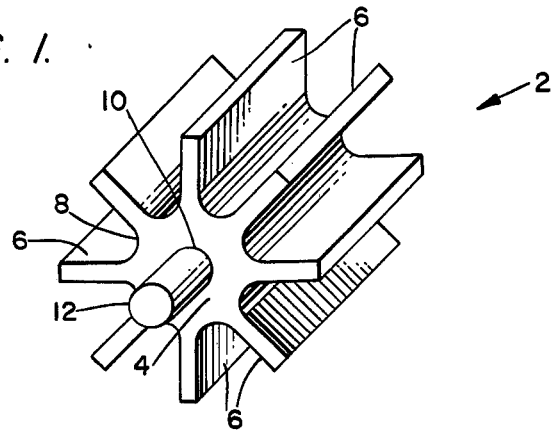
FIG. 1 is a perspective view of the vaned rotor employed in the heat source of the present invention.

The heat source of the present invention will now be described in detail. The sole moving part of the heat source is the vaned or lobed rotor structure indicated at 2 in FIG. 1. Rotor structure 2 includes a thickened center section 4 with a series of vanes or fins 6 radiating outwardly therefrom. In the preferred embodiment of the present invention eight such vanes 6 are shown, but either a greater or lesser number of vanes may be employed if desired. Rotor 2 may be cast or machined from metal stock or other suitably durable material. A plurality of curved fillets 8 respectively interconnect vanes 6 at the juncture between the vanes and center section 4. Fillets 8 serve to strengthen the vanes and assist in maintaining streamlined fluid flow conditions between the vanes during rotor rotation. A hole 10 is bored through center section 4 along the rotational axis of rotor 2, and a cylindrical shaft 12 is securely mounted in hole 10 to complete the rotor assembly.

Figure 2:
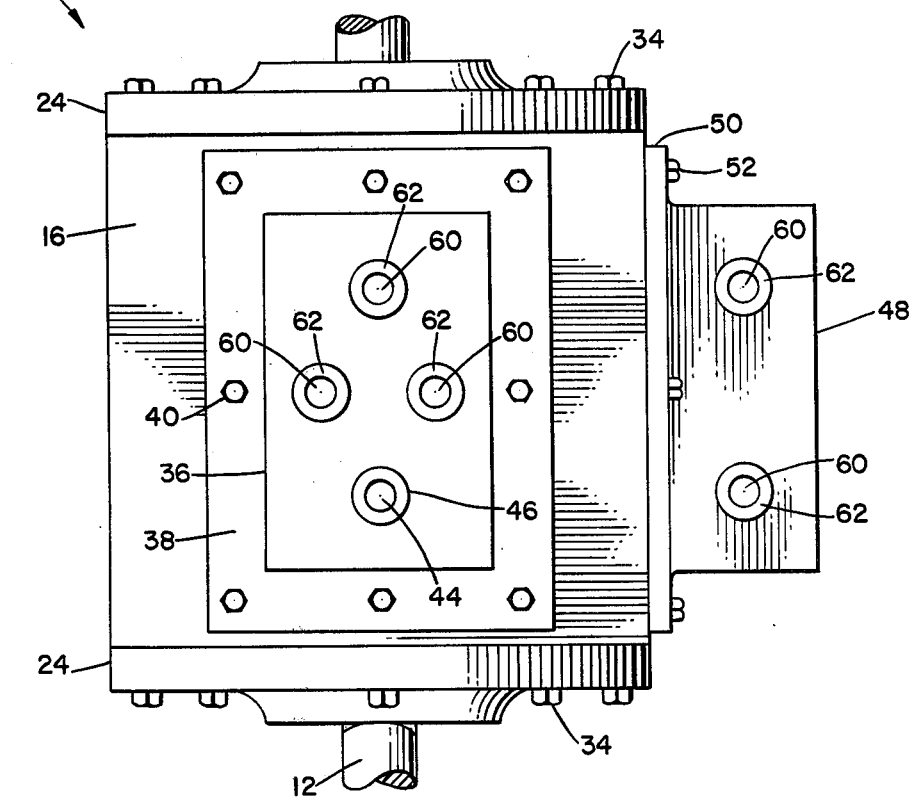
FIG. 2 is a top view of the heat source of the present invention.
Figure 4:
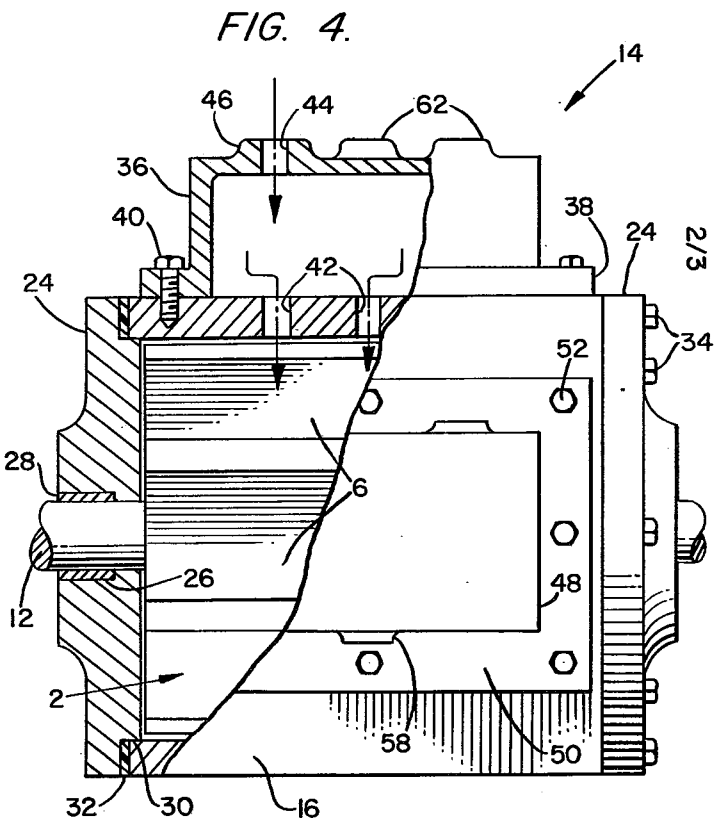
FIG. 4 is a side view in partial cross-section of the heat source illustrated in FIGS. 2 and 3.
Figure 3:
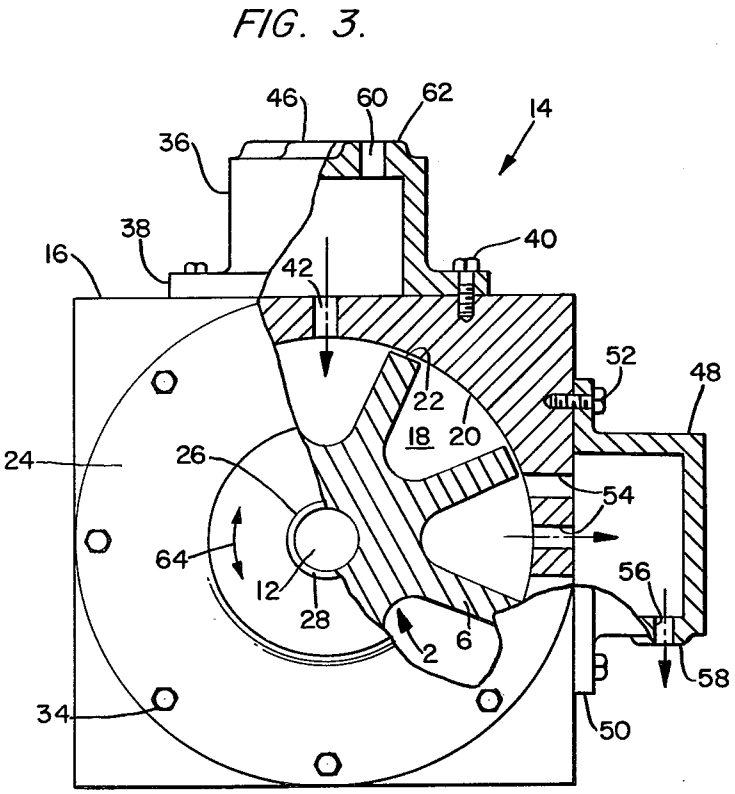
FIG. 3 is a front view in partial cross-section of the heat source illustrated in FIG. 2.

FIGS. 2, 3 and 4 respectively provide top, front (including a partial cross-section) and side (also including a partial cross-section) views of a heat source 14 constructed in accordance with the present invention, wherein the rotor 2 illustrated in FIG. 1 is rotatably supported inside a casing 16 for the purpose of generating heat. Casing 16, which may be fabricated from a block of metal, has a cylindrical cavity 18 formed therein to accomodate rotor 2. The dimensions of rotor 2 and cavity 18 are chosen to provide only minimal clearance between the interior surface 20 of the cavity and the tips 22 of rotor vanes 6. Cavity 18 is sealed at both ends of casing 16 by end plates 24 to form a fluid-tight enclosure for rotor 2. Each of the end plates contains a center bore 26 through which shaft 12 projects to the exterior of casing 16. Each of the center bores 26 may be enlarged to house a bearing 28 which supports rotor 2 for rotation within cavity 18. An annular lip 30 having a diameter equal to the diameter of cavity 18 may be formed on the interior of each end plate 24 to aid in the sealing arrangement between the end plates and casing 16, and a gasket 32 inserted between each end plate and the casing further enhances the fluid tight character of the cavity. End plates 16 may be securely fastened to casing 16 by bolts 34.

A hollow return reservoir 36 having a flange 38 formed around the bottom periphery thereof is attached to the top of casing 16 via bolts 40. A series of inlet ports 42, only two of which are shown in FIG. 4, are drilled through casing 16 to provide for fluid communication between cavity 18 and the interior of return reservoir 36, while a return port 44 drilled through the top of a reinforcing boss 46 on return reservoir 36 provides for fluid communication between the interior of the return reservoir and a fluid return conduit (not shown in FIGS. 2–4) connected to return port 44. In similar fashion, a supply reservoir 48 having a peripheral flange 50 is attached to the side of casing 16 via bolts 52 and a series of outlet ports 54 are drilled through the side of casing 16 to provide for fluid communication between cavity 18 and the interior of supply reservoir 48. A supply port 56 drilled through a reinforcing boss 58 on the side of supply reservoir 48 provides fluid communication between the interior of the supply reservoir and a supply conduit (not shown in FIGS. 2–4) connected to supply port 56. If desired, additional accessory ports 60 and reinforcing bosses 62 may be formed in both the return reservoir 36 and supply reservoir 48 to receive fluid monitoring instruments or other accessory structures.

Heat is generated by heat source 14 in response to the kinetic interaction between rotor 2 and a heat transfer fluid which is conducted into cavity 18 of the heat source from an external fluid circuit as described below in connection with FIG. 6. The heat transfer fluid may be a compressible fluid having relatively low viscosity, such as light weight motor oil, transmission fluid or commercially available heat transfer fluid. Referring in particular to FIGS. 3 and 4, it can be seen that the heat transfer fluid flowing into return port 44 from the external fluid circuit, as indicated by the corresponding arrow, first collects in the interior of return reservoir 36 and thereafter passes through inlet ports 42 to circulate around the rotor vanes 6 positioned within cavity 18. The circulating fluid then passes through outlet ports 54 to the interior of supply reservoir 48 as indicated by the corresponding arrow and subsequently leaves the supply reservoir via supply port 56 to complete a fluid flow path through heat source 14. During the heat generating cycle, rotor 2 is rotated in either a clockwise or counterclockwise direction as indicated by arrow 64, causing the various fluid particles heretofore freely circulating within cavity 18 to acquire an ordered velocity and momentum. The mechanical energy of motion thus imparted to the fluid particles is readily available for conversion into other forms of energy in accordance with well known principles of fluid dynamics. For example, if heat source 14 were to be operated in the conventional pumping-type mode of prior art devices, a portion of the mechanical energy of motion absorbed by the fluid particles would be converted into discharge or head pressure at the outlet ports 54 to provide a conventional pumping action. Another portion of the mechanical energy of motion absorbed by the fluid particles would be converted into heat, principally due to the turbulent impact of the fluid particles with cavity surface 20 following the centrifugal acceleration of the particles along the rotor vanes. In the preferred embodiment of the present invention, however, the return and supply ports 44, 56 are completely blocked in contravention of accepted pump operating practices to effectively "dead-head" the heat source on the supply reservoir side. Consequently, no discharge pressure need be maintained by the fluid and all of the mechanical energy of motion absorbed by the fluid particles within cavity 18 is available for conversion into heat. The actual heat conversion process, moreover, tends to be more efficient than that which occurs in prior art devices designed to simultaneously furnish discharge pressure and heat, due to the fact that the sealing of return and supply ports 44, 56 significantly reduces turbulence at the inlet and outlet ports 42, 54 to enable the formation of a streamline flow condition within cavity 18. The heat imparted to the body of heat transfer fluid flowing in streamline fashion through cavity 18 thus results from shear or frictional forces occuring between various layers of fluid particles and the energy otherwise randomly contributing to turbulent flow conditions instead tends to increase the overall production of frictional heat. As an added advantage, the streamline flow conditions prevailing in cavity 18 during rotor rotation lessen the possibility of cavitation and the attendant wear on the moving rotor 2 of heat source 14. The heat transfer fluid itself, which as previously mentioned may comprise a light grade oil or other slightly viscous fluid, also inherently lubricates the rotor shaft 12 to further reduce wear.

Figure 5:
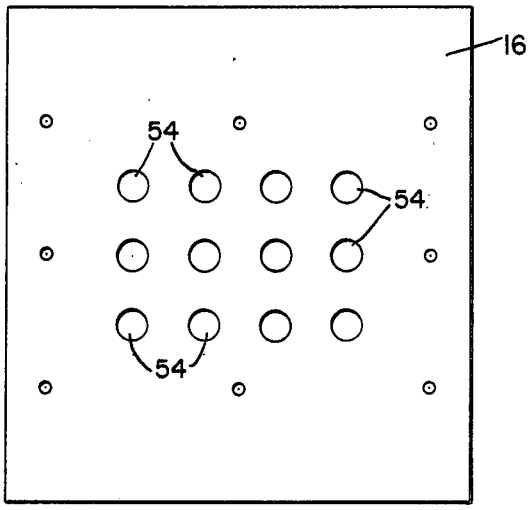
FIG. 5 is a side view of the heat source casing showing the arrangement of the heat transfer fluid outlet ports.

Heat energy produced by frictional or shearing forces acting on the body of compressible heat transfer fluid during streamline flow conditions is partially transferred to casing 16 and partially retained by the heat transfer fluid to raise the temperature thereof. This rise in temperature in turn causes the heat transfer fluid to expand. The interior volumes of the return and supply reservoirs 36, 48 are made sufficiently large to account for such expansion, thereby keeping the internal fluid pressure against which rotor vanes 6 must work at an acceptable level. As seen to best advantage in FIG. 5, outlet ports 54 can be arranged in a matrix pattern across the entire area bounded by supply reservoir 48 to increase the rate at which the expanding heat transfer fluid flows into the supply reservoir. In this manner the capacity of the supply reservoir 48 to maintain acceptable internal fluid pressures is more fully exploited. The matrix pattern of outlet ports 54 also tends to reduce turbulence within cavity 18 and accordingly contributes to the maintenance of streamline flow conditions. Although twelve outlet ports 54 in a three by four array are illustrated in FIG. 5, it is understood that other arrangements of outlet ports may also be employed with satisfactory results.

Figure 6:
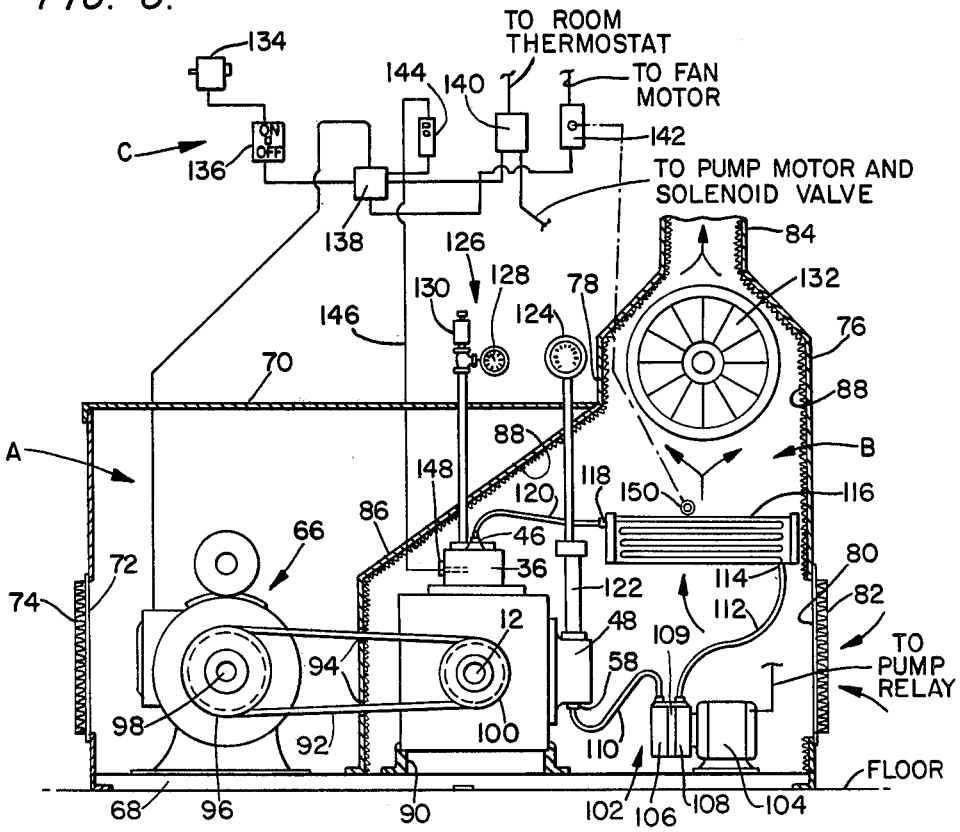
FIG. 6 is a schematic view of a heat generating and transfer system employing the heat source of the present invention.

A heating system designed to interface with the heat source 14 of the present invention and suitable for use in supplying heat to a residential or other type of building is illustrated in FIG. 6. The heating system includes a drive section A, a heat generating and transfer section B and an electrical control system C. Drive section A includes a drive motor 66 such as a standard induction motor secured to a floor frame 68. Drive motor 66 may be enclosed in a housing 70 fabricated from sheet metal or other rigid material, in which case at least one cooling vent 72 having a filter 74 affixed thereto is formed in housing 70 to provide for a constant flow of air around drive motor 66.

Heat generating and transfer section B comprises a housing 76 which is joined to housing 70 along surface 78. Housing 76 includes an air vent 80 covered by a filter 82 through which air is drawn into the interior of the housing. Once heated, the air can be discharged through a stack section 84 for distribution to a heat utilization site. If desired, housing 76 can also be fabricated from sheet metal or the like and a partition 86 can be constructed to separate drive section A from heat generating and transfer section B. A layer of insulating material 88 affixed to the interior surface of housing 76 serves to minimize heat loss from the heat generating and transfer section B. Heat source 14 is mounted within housing 76 and is fixedly secured to floor frame 68 via a base frame 90. In the preferred embodiment of FIG. 6, rotor shaft 12, and hence rotor 2 (not shown in FIG. 6) is rotatably driven by a belt 92 which passes through two openings 94 in partition 86 to frictionally engage both the motor sheave 96 attached to motor drive shaft 98 and the rotor sheave 100 attached to rotor shaft 12. A direct drive mechanism, however, could also be utilized with equal success to interconnect motor drive shaft 98 with the rotor shaft. A fluid pump 102 driven by a pump motor 104 is also secured to floor frame 68 within housing 76. Fluid pump 102 includes an inlet section 106, an outlet section 108 and a valve section 109 having a solenoid-operated valve structure (not shown) mounted therein to completely block fluid flow between the inlet and outlet sections 106, 108 when pump motor 104 is not operating. To this end, the solenoid-operated valve may be electrically connected in series with the pump motor power line. A first supply conduit 110 interconnects the supply port 56 (not shown in FIG. 6) of heat source supply reservoir 48 with the inlet section 106 of fluid pump 102 to provide a flow path between the fluid pump and the supply reservoir. A second supply conduit 112 interconnects the outlet section 108 of fluid pump 102 with the inlet 114 of a heat exchange unit 116 and accordingly provides a flow path therebetween. Heat exchange unit 116 may be a standard flat-face extended heat transfer surface coil through which heat transfer fluid may freely circulate, but other structural arrangements for maximizing the available heat transfer surface could also be employed. The outlet 118 of heat exchange unit 116 is interconnected with the return port 44 (not shown in FIG. 6) of heat source return reservoir 36 by a return conduit 120. It can thus be seen that a complete fluid circuit is formed from supply reservoir 48 through first supply conduit 110, fluid pump inlet, valve and outlet sections 106, 109, 108, second supply conduit 112, heat exchange unit 116, return conduit 120 and return reservoir 36 back through heat source 14 to supply reservoir 48.

As discussed above, the accessory ports 60 (not shown in FIG. 6) and bosses 62 formed on the return and supply reservoirs 36, 48 of heat source 14 can be adapted to receive various types of accessory structures and measuring instruments. For example, a fill conduit 122 can be aligned with an accessory port on supply reservoir 48 to furnish a convenient means for adding heat transfer fluid to heat source 14 when necessary. A temperature gauge 124 can be inserted in another accessory port to furnish a visual means for obtaining the temperature of the heat transfer fluid within heat source 14. A pressure regulating device 126, including an oil pressure gauge 128 and an automatic pressure relief valve 130 may be inserted in one of the return reservoir accessory ports. Automatic pressure relief valve 130 functions to relieve pressure in the heat source whenever pressure buildup inside return reservoir 36 reaches a predetermined critical level. Any unused accessory ports are capped to prevent leakage of heat transfer fluid from the heat source.

The air to be heated in heat generating and transfer section B is drawn through air vent 80 and across the surface of heat exchange unit 116 by a fan 132 as indicated generally in FIG. 6. The fan 132 may be a squirrel cage-type fan. The temperature of the air passing through air vent 80 is thus raised by passing in heat exchange relationship with the heat transfer fluid in heat exchange unit 116, and may thereafter be distributed through stack 84 and associated heating conduits (not shown) to a utilization site.

The electrical control system C includes a main switch 134 connected to a conventional source of electrical power, an on-off switch 136 for interrupting the supply of power to electrical control system C and a junction box 138 which distributes power from the main switch box 134 to drive motor 66, pump motor relay 140 and fan motor relay 142. A high temperature limit control 144 governs the operation of junction box 138 in response to the sensed temperature of the heat transfer fluid in heat source 14. High temperature limit control 144, which may be constructed in the form of a fluid aquastat, receives a control signal via leads 146 from a thermostat 148 mounted on return reservoir 36 to sense the temperature of the heat transfer fluid collected therein. Pump motor relay 140 receives a control signal from a conventional room thermostat (not shown), while fan motor relay 142 receives a control signal from a helix-type thermostat 150 mounted adjacent the heat transfer surface of heat exchange unit 116. Pump motor relay 140 is, of course, connected to pump motor 104, and fan motor relay 142 is connected to the motor (not shown) which drives fan 132. As previously mentioned, the solenoid valve mounted within valve section 109 of fluid pump 102 can be connected in electrical series between relay 140 and pump motor 104 to obtain optimum coordination between the operation of the pump motor and the solenoid valve.

The heat generating cycle of heating system illustrated in FIG. 6 is initiated by moving on-off switch 136 to the on position, whereupon power is conducted from main switch box 134 to junction box 138. At start-up, the heat transfer fluid within heat source 14 is at an ambient temperature, and high temperature limit control 144 functions to permit the flow of power through junction box 138 to drive motor 66 while blocking the flow of power through junction box 138 to pump motor relay 140 and fan motor relay 142. Drive motor 66 is activated to rotate rotor 2 (not shown in FIG. 6) within cavity 18 (not shown in FIG. 6) of heat source 14. Simultaneously, the blockage of power flow between junction box 138 and pump motor relay 140 prevents the activation of pump motor 104 and the series-connected solenoid valve in valve section 109 of fluid pump 102. Thus, heat source 14 is effectively "dead-headed" and the flow of heat transfer fluid therethrough is prevented. The rotation of rotor 2 within cavity 18 subsequently increases the temperature of the heat transfer fluid within heat source 14 as described in connection with FIGS. 2, 3 and 4. The temperature of the heat transfer fluid continues to increase during a first interval of time until a predetermined level is reached, whereupon thermostat 148 mounted on return reservoir 36 produces an electrical signal which triggers high temperature limit control 144 to initiate the heat transfer cycle. High temperature limit control 144 then functions to block the flow of current from junction box 138 to drive motor 66 while permitting current to flow from the junction box to pump motor relay 140 and fan motor relay 142. Assuming the room thermostat which controls pump motor relay 140 signals a demand for heat, relay 140 closes to energize the pump motor 104 and the solenoid valve contained within the fluid pump 102. Hot heat transfer fluid from heat source 14 is then pumped by pump 102 from supply reservoir 48 through first and second supply conduits 110, 112, heat exchange unit 116 and return conduit 120 to return reservoir 36. The temperature of the heat exchange unit 116 rises in response to the flow of hot heat transfer fluid, eventually reaching a level which causes helix thermostat 150 to close fan motor relay 142. The fan motor relay energizes the fan motor (not shown) with power from junction box 138 and fan 132 operates as previously described to draw air through vent 80 into heat transfer relationship with the hot heat transfer fluid circulating through heat exchange unit 116.

Following a second interval of time, the temperature of the heat transfer fluid circulating through heat generating and transfer section B drops to a predetermined level as determined by thermostat 148, at which point high temperature limit control 144 reverses in operation to block current flow from junction box 138 to relays 140, 142 and reopen the circuit connection between drive motor 66 and the junction box. The blockage of power to relay 140 shuts pump motor 104 off and simultaneously closes the solenoid valve in valve section 109 of fluid pump 102. Thereafter, the heat transfer fluid within heat source 14 is reheated to the predetermined high level and the heat transfer cycle is repeated. It can now be seen that the temperature of the heat transfer fluid in heat source 14 is generally maintained at a level sufficient to effect maximum heat transfer in heat exchange unit 116. The presence of helix thermostat 150 further insures that no air will be distributed through the heating system during those periods where the temperature of the heat transfer fluid is insufficient to affect the desired heat exchange relationship.

Only one embodiment of the present invention has been specifically shown and described herein. It is understood, however, that additional changes and modifications to the form and detail of the heat source and heating system illustrated above may be made by those skilled in the art without departing from the scope and spirit of the present invention. It is thus the intention of the inventors to be limited only by the following claims.

We claim:

1. An apparatus for generating combustionless heat from the mechanical energy of motion imparted to a heat transfer fluid, said apparatus comprising:

(a) a casing structure having a cavity formed therein through which the heat transfer fluid may circulate, said casing structure also including inlet means and outlet means for respectively directing the passage of heat transfer fluid into and out of said cavity;

(b) rotor means mounted within said cavity for imparting mechanical energy of motion in the form of a rotational flow to a volume of heat transfer fluid contained within said cavity during a first interval; and (c) heat generating control means positioned between said inlet means and said outlet means for confining said volume of the heat transfer fluid within said cavity during said first interval and for permitting substantial circulation of the heat transfer fluid into, through and out of said cavity during a second interval, said heat generating control means including a blocking means for preventing the passage of any portion of said volume of heat transfer fluid through said inlet means and said outlet means to confine said volume of heat transfer fluid within said cavity during said first interval causing the rotational flow of said volume of heat transfer fluid to be maintained in essentially nonturbulent, streamlined flow condition during said first interval and the mechanical energy of motion imparted to said volume of heat transfer fluid during said first interval to be used primarily to increase the temperature of said volume of heat transfer fluid.

2. An apparatus as set forth in claim 1, wherein said rotor means includes a plurality of radial blades configured such that a substantial amount of said volume of heat transfer fluid confined within said cavity during said first interval is retained between said blades.

3. An apparatus as set forth in claim 1, including a heat exchange means for effecting the transfer of heat between an absorbing medium and said volume of heat transfer fluid having said increased temperature, said heat exchange means including a conduit means for conducting said portion of heat transfer fluid having said increased temperature to said heat exchange means during said second interval.

4. An apparatus as set forth in claim 1, wherein said housing structure includes a first reservoir means for collecting heat transfer fluid prior to the direction of the heat transfer fluid through said inlet means and a second reservoir means for collecting heat transfer fluid subsequent to the direction of the heat transfer fluid through said outlet means.

5. A heat generating and transfer system which obtains usable heat from the mechanical energy of motion imparted to a heat transfer fluid, said heat generating and transfer system comprising:

(a) a heat source including a casing structure having a cavity formed therein through which a volume of heat transfer fluid may circulate, said casing structure also having inlet means and outlet means for respectively directing the passage of heat transfer fluid into and out of said cavity, said heat source additionally including a rotor means mounted within said cavity for imparting mechanical energy of motion in the form of an essentially streamlined rotational flow to the heat transfer fluid during a first interval when said heat transfer fluid is completely confined within said cavity such that substantially all of the mechanical energy of motion imparted to the heat transfer fluid is used to increase the temperature of the heat transfer fluid; and (b) a heat exchange means for effecting the transfer of heat between an absorbing medium and the heat transfer fluid during a second interval when said heat transfer fluid is free to circulate through said system, said heat exchange means including a conduit means for conducting the heat transfer fluid from said cavity of said heat source to said heat exchange means.

6. A heat generating and transfer system as set forth in claim 5, including a heat generating control means for confining said volume of heat transfer fluid within said cavity during a first interval and for permitting substantial circulation of said volume of heat transfer fluid between said cavity and said heat exchange means during a second interval, said heat generating control means including a blocking means positioned between said inlet means and said outlet means for preventing the passage of heat transfer fluid through said inlet means and outlet means of said heat source to confine said volume of heat transfer fluid within said cavity during said first interval such that the rotational flow of said portion of heat transfer fluid is maintained in essentially nonturbulent, streamlined flow condition during said first interval while the mechanical energy of motion imparted to said portion of heat transfer fluid during said first interval is primarily used to increase the temperature of said volume of heat transfer fluid.

7. A heat generating and transfer system as set forth in claim 6, wherein said blocking means includes a fluid pump having inlet and outlet sections interconnected via a valve structure.

8. A heat generating and transfer system as set forth in claim 7, including a drive motor means mechanically interconnected with said heat source to cause said rotor means to rotate within said cavity.

9. A heat generating and transfer system as set forth in claim 8, including a fan means for circulating air over said heat exchange means to effect a heat transfer relationship between the air and said portion of heat transfer fluid circulated between said cavity and said heat exchange means.

10. A heat generating and transfer system as set forth in claim 9, wherein said heat generating control means also includes an electrical control circuit means for supplying power to said drive motor means during said first interval and for supplying power to said fluid pump and said fan means during said second interval.

11. A heat generating and transfer system which obtains usable heat from the mechanical energy of motion imparted to a heat transfer fluid, said heat generating and transfer system comprising:

(a) a heat source including a casing structure having a cavity formed therein through which the heat transfer fluid may circulate, said casing structure also having inlet and outlet means for respectively directing the passage of heat transfer fluid into and out of said cavity, said heat source additionally including a rotor means mounted within said cavity for imparting mechanical energy of motion in the form of an essentially streamlined rotational flow to the heat transfer fluid present within said cavity such that substantially all of the mechanical energy of motion imparted to the heat transfer fluid is used to increase the temperature of the heat transfer fluid; and (b) a heat exchange means for effecting the transfer of heat between an absorbing medium and the heat transfer fluid, said heat exchange means including a conduit means for conducting the heat transfer fluid from said cavity of said heat source to said heat exchange means, said heat generating transfer and control system including a heat generating control means for confining the heat transfer fluid within said cavity during a first interval and for permitting a substantial circulation of said portion of heat transfer fluid between said cavity and said heat exchange means during a second interval, said heat generating control means including a blocking means for preventing the passage of heat transfer fluid through said inlet and outlet means of said heat source to confine said portion of heat transfer fluid within said cavity during said first interval such that the rotational flow of said portion of heat transfer fluid is maintained in essentially streamlined flow condition during said first interval while the mechanical energy of motion imparted to said portion of heat transfer fluid during said first interval is primarily used to increase the temperature of said portion of heat transfer fluid, said blocking means including a fluid pump having inlet and outlet sections interconnected via a valve structure, said heat generating transfer and control system further including a drive motor means mechanically interconnected with said heat source to cause said rotor means to rotate within said cavity, and a fan means for circulating air over said heat exchange means to effect a heat transfer relationship between the air and said portion of heat transfer fluid circulated between said cavity and said heat exchange means, said heat generating control means also including an electrical control circuit means for supplying power to said drive motor means during said first interval and for supplying power to said fluid pump and said fan means during said second interval, and wherein said electrical control circuit means includes a high temperature limit control means for interrupting the supply of power to said fluid pump and said fan means during said first interval and for interrupting the supply of power to said drive motor means to initiate said second interval when the temperature of said portion of heat transfer fluid confined within said cavity during said first interval reaches a predetermined level.

12. A heat generating and transfer system as set forth in claim 11, wherein said high temperature limit control means includes a first thermostat means connected to said heat source for measuring said predetermined level of temperature.

13. A heat generating and transfer system as set forth in claim 11, wherein said electrical control circuit means also includes a fluid pump relay means for interrupting the supply of power to said fluid pump during said second interval, said fluid pump relay means having a second thermostat means connected thereto for supplying a control signal to said fluid pump relay means.

14. A heat generating and transfer system as set forth in claim 11, wherein said electrical control circuit means also includes a fan motor relay means for interrupting the supply of power to said fan means during said second interval, said fan motor relay means having a third thermostat means for supplying a control signal to said fan motor relay means.

15. A method for generating combustionless heat by imparting the mechanical energy of motion to a heat transfer fluid, said method comprising the steps of:

(a) placing a volume of the heat transfer fluid within an enclosed area having an inlet and an outlet;

(b) during a first interval imparting mechanical energy of motion in the form of a rotational flow to said volume of heat transfer fluid placed within said enclosed area;

(c) confining said volume of heat transfer fluid completely within said enclosed area during said first interval by blocking said inlet and outlet such that the rotational flow of said portion of heat transfer fluid is maintained in essentially nonturbulent, streamlined flow condition during said first interval while the mechanical energy of motion imparted to said volume of heat transfer fluid during said first interval is primarily used to increase the temperature of said volume of heat transfer fluid;

(d) during a second interval unblocking said inlet and outlet to cause said volume of increased temperature heat transfer fluid to flow through the outlet of said enclosed area, to circulate through heat exchange means and to return to said enclosed area through said inlet; and (e) repeating steps (b), (c) and (d) for the number of times required to generate the amount of combustionless heat desired.

* * * * *